US007372416B1

(12) United States Patent
Marchessault et al.

(10) Patent No.: US 7,372,416 B1
(45) Date of Patent: May 13, 2008

(54) ANTENNA FLAG SYSTEM

(76) Inventors: Timothy R. Marchessault, 1306 SE. 46th La., Suite, Cape Coral, FL (US) 33904; Robin Lee Marchessault, 1306 SE. 46th La., Suite, Cape Coral, FL (US) 33904

( * ) Notice: Subject to any disclaimer, the term of this patent is extended or adjusted under 35 U.S.C. 154(b) by 0 days.

(21) Appl. No.: 11/638,721

(22) Filed: Dec. 14, 2006

(51) Int. Cl.
*H01Q 1/32* (2006.01)

(52) U.S. Cl. ..... 343/715; 343/711; 428/31; 116/28 R

(58) Field of Classification Search ..... 343/711, 343/712, 713, 715; 428/31; 116/28 R
See application file for complete search history.

(56) References Cited

U.S. PATENT DOCUMENTS 1,439,644 A 12/1922 Scharek
5,816,187 A * 10/1998 Jimmie ..... 116/173
6,278,408 B1 * 8/2001 Segovia, Jr. ..... 343/715
6,748,683 B1 6/2004 Schultz
7,017,510 B1 3/2006 Nair
2005/0263060 A1 * 12/2005 Armstrong ..... 116/28 R

* cited by examiner

*Primary Examiner*—Hoanganh Le
*Assistant Examiner*—Dieu Hien T Duong
(74) *Attorney, Agent, or Firm*—Louis J. Brunoforte

(57) ABSTRACT

A slidable assembly has a cylindrical section with an upper passageway and an axial slit. The slidable assembly also has a support section with an upper strip extending from the upper end of the cylindrical section and a lower strip extending from the lower end of the cylindrical section. A flag has upper and lower edges supported by the strips. A liftable assembly has a wing shaped component and a central passageway. A short projection extends upwardly press fit into the lower end of the cylindrical section of the slidable assembly. An intermediate cylindrical passageway is formed as a coupling between the lower and upper passageway.

6 Claims, 5 Drawing Sheets

FIG 1
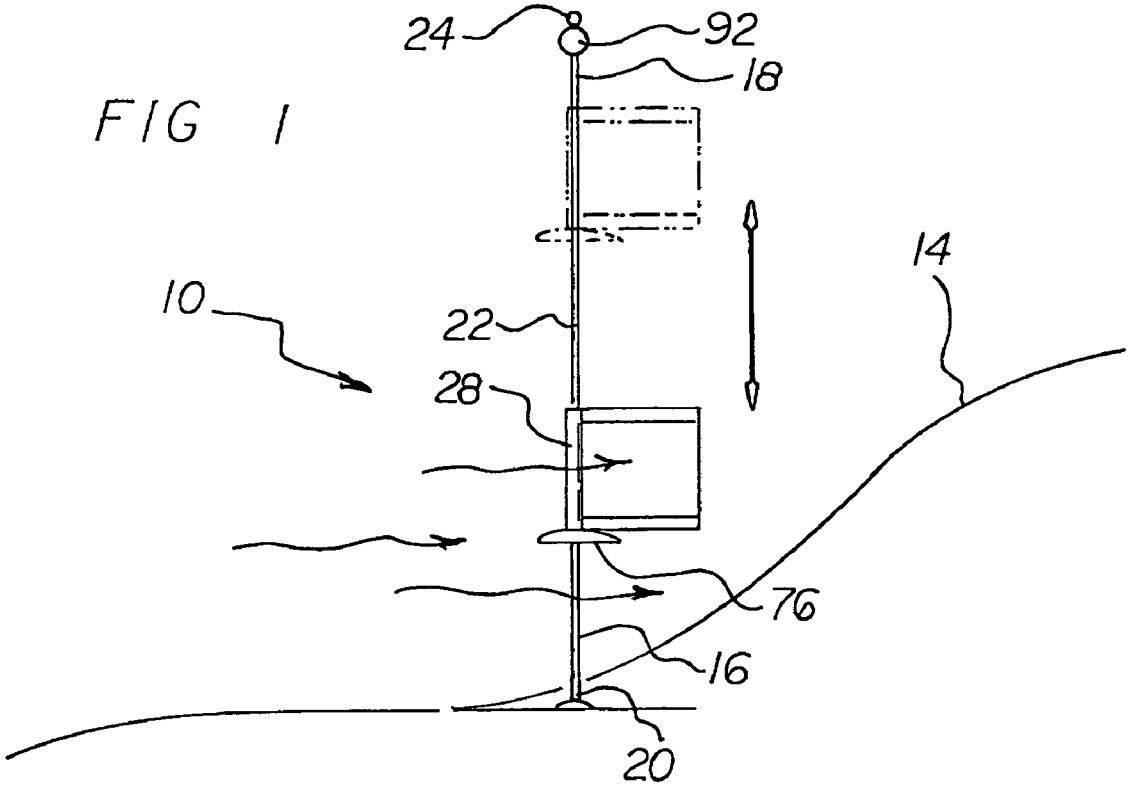
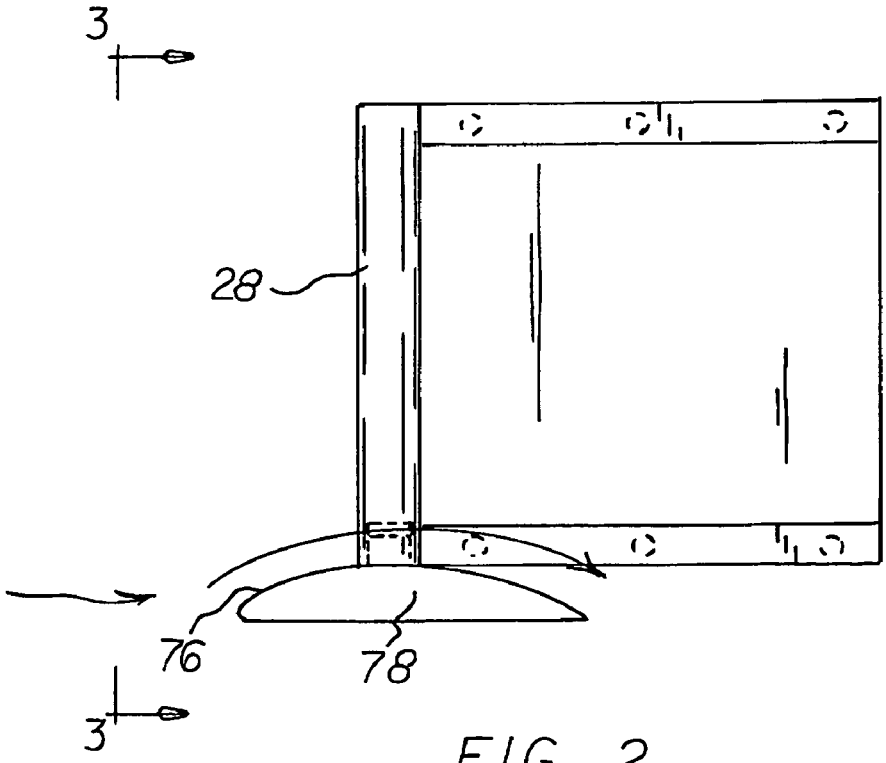
FIG 2

FIG 3
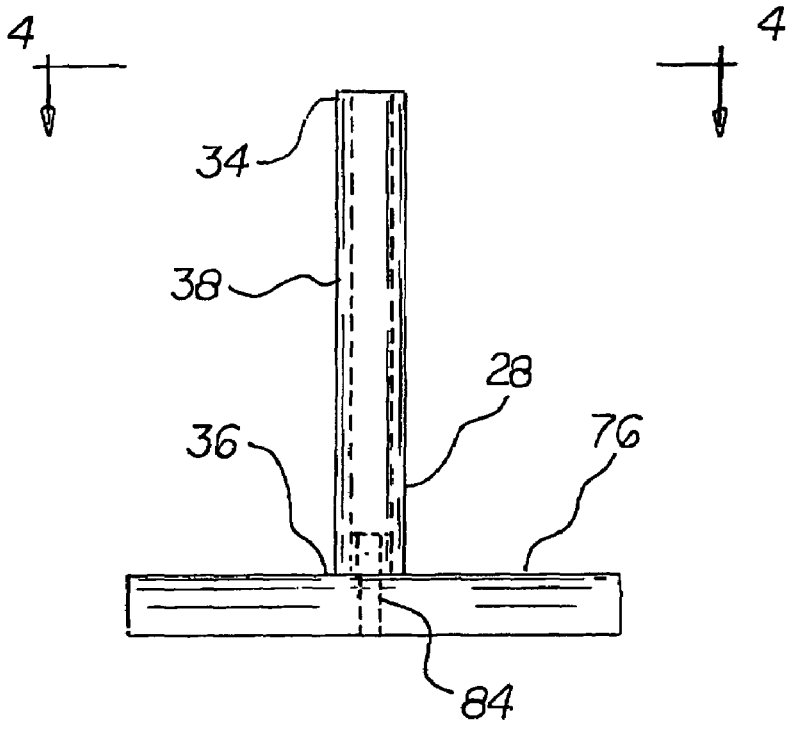
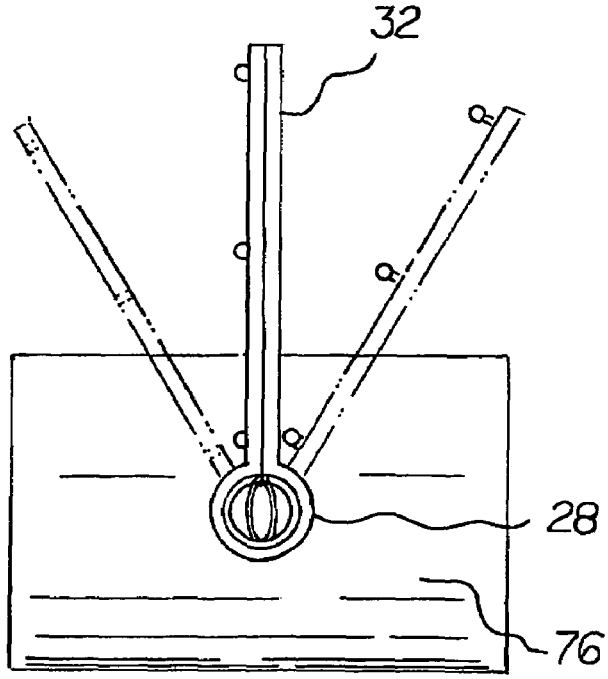
FIG 4

FIG 8
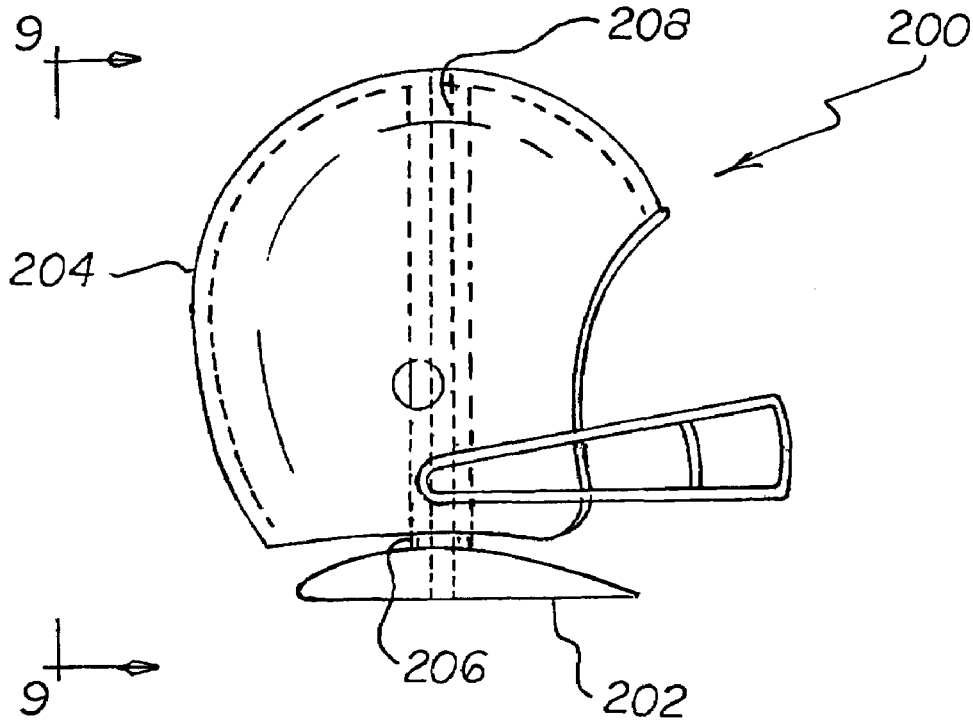
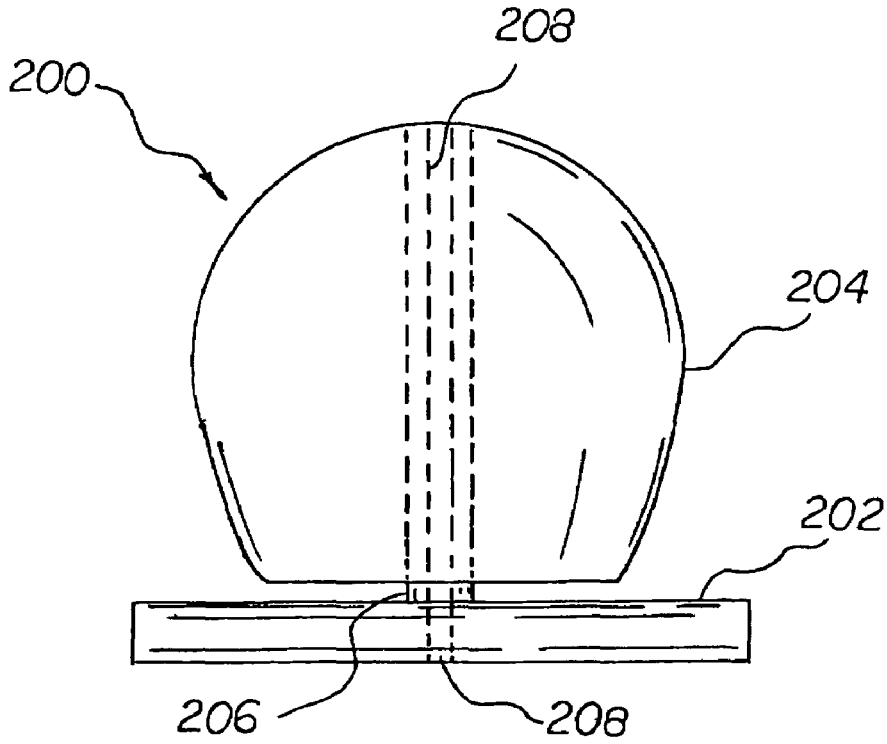
FIG 9

ANTENNA FLAG SYSTEM

BACKGROUND OF THE INVENTION

1. Field of the Invention

The present invention relates to an antenna flag system and more particularly pertains to slidably positioning a flag on a vehicle antenna and then raising and lowering the flag in response to the speed of the vehicle.

2. Description of the Prior Art

The use of flag assemblies of known designs and configurations is known in the prior art. More specifically, flag assemblies of known designs and configurations previously devised and utilized for the purpose of positioning flags through known methods and apparatuses are known to consist basically of familiar, expected, and obvious structural configurations, notwithstanding the myriad of designs encompassed by the crowded prior art which has been developed for the fulfillment of countless objectives and requirements.

By way of example, U.S. Pat. No. 1,439,644 issued Dec. 19, 1922 to Scharek relates to a Flag Ornament. U.S. Pat. No. 6,748,683 issued Jun. 15, 2004 to Schultz relates to a Boat Antenna Flag System. Lastly, U.S. Pat. No. 7,017,510 issued Mar. 28, 2006 to Nair relates to a Artificial Wind Producing Flag Pole Assembly.

While these devices fulfill their respective, particular objectives and requirements, the aforementioned patents do not describe an antenna flag system that allows slidably positioning a flag on a vehicle antenna and then raising and lowering the flag in response to the speed of the vehicle.

In this respect, the antenna flag system according to the present invention substantially departs from the conventional concepts and designs of the prior art, and in doing so provides an apparatus primarily developed for the purpose of slidably positioning a flag on a vehicle antenna and then raising and lowering the flag in response to the speed of the vehicle.

Therefore, it can be appreciated that there exists a continuing need for a new and improved antenna flag system which can be used for slidably positioning a flag on a vehicle antenna and then raising and lowering the flag in response to the speed of the vehicle. In this regard, the present invention substantially fulfills this need.

SUMMARY OF THE INVENTION

In view of the foregoing disadvantages inherent in the known types of flag assemblies of known designs and configurations now present in the prior art, the present invention provides an improved antenna flag system. As such, the general purpose of the present invention, which will be described subsequently in greater detail, is to provide a new and improved antenna flag system and method which has all the advantages of the prior art and none of the disadvantages.

To attain this, the present invention essentially comprises an antenna flag system. First provided is a vehicle. The vehicle is adapted to move horizontally. The vehicle has an essentially vertical antenna. The antenna has a free upper end. The antenna has a lower end. The antenna is attached to the vehicle with an intermediate extent. The intermediate extent is between about 12 and 36 inches in length. The antenna has a generally cylindrical configuration between the upper and lower ends. The upper end is formed with a sphere.

A slidable assembly is provided. The slidable assembly is integrally formed with a cylindrical section and a support section. The cylindrical section has an upper end. The cylindrical section has a lower end. The cylindrical section also has an intermediate extent. The intermediate extent is between about 4 and 8 inches. The intermediate extent is located between the upper and lower ends. The cylindrical section has an interior surface. The cylindrical section has an exterior surface. The cylindrical section also has an axial slit. The axial slit is adapted to be separated. In this manner a space for positioning the slidable assembly onto the antenna and for removing the slidable assembly from the antenna is formed. The axial slit is adapted to be closed. In this manner a closed upper cylindrical passageway for allowing movement of cylindrical section along the antenna is formed.

The support section has a planar upper male strip. The support section has a planar upper female strip. The planar upper female strip extends from the exterior surface adjacent to the upper end of the cylindrical section. The support section has a planar lower male strip. The support section also has a planar lower female strip. The planar lower female strip extends from the exterior surface adjacent to the lower end of the cylindrical section. The male strips have three laterally spaced projections. The laterally space projections have enlarged heads. The female strips have three laterally spaced apertures. The apertures are adapted to receive and frictionally retain the enlarged heads when the axial slit is closed. In this manner the enlarged heads and apertures are separated when the axial slit is opened.

The upper strips and lower strips are axially separated to form a rectangular space between the upper and lower strips. A flag is provided. The flag has an upper edge. The upper edge is formed with three laterally aligned upper slits. The upper slits receive the projections of the upper male strip. The flag has a lower edge. The lower edge is formed with three laterally aligned lower slits. The lower slits receive the projections of the lower male strip. The flag has an inner edge with a loop. The loop slidably receives the antenna.

Provided last is a liftable assembly. The liftable assembly has a laterally extending wing shaped component. The liftable assembly has an arcuate upper surface and an essentially flat lower surface. The liftable assembly further has a centrally oriented lower cylindrical passageway there through between the upper and lower surfaces. The liftable assembly has a short cylindrical projection. The short cylindrical projection extends upwardly from the upper surface press fit into the lower end of the cylindrical section of the slidable assembly. The liftable assembly has an intermediate cylindrical passageway. The intermediate cylindrical passageway is formed as a coupling between the lower cylindrical passageway between the upper and lower surfaces and the upper cylindrical passageway. In this manner increased motion of the vehicle is adapted to exert an increased aerodynamic lifting force to the liftable and slidable assemblies. Further in this manner the flag is raised and decreased motion of the vehicle is adapted to exert a decreased aerodynamic lifting force to the liftable and slidable assemblies for lowering the flag. The liftable assembly includes a magnet. The magnet is removably positioned upon the sphere of the antenna. The magnet is of a size greater than that of the upper cylindrical passageway. In this manner movement of the slidable assembly and flag upwardly from the antenna is precluded.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved antenna flag system which has all of the advantages of the prior art flag assemblies of known designs and configurations and none of the disadvantages.

It is another object of the present invention to provide a new and improved antenna flag system which may be easily and efficiently manufactured and marketed.

It is further object of the present invention to provide a new and improved antenna flag system which is of durable and reliable constructions.

An even further object of the present invention is to provide a new and improved antenna flag system which is susceptible of a low cost of manufacture with regard to both materials and labor, and which accordingly is then susceptible of low prices of sale to the consuming public, thereby making such antenna flag system economically available to the buying public.

Even still another object of the present invention is to provide an antenna flag system for slidably positioning a flag on a vehicle antenna and then raising and lowering the flag in response to the speed of the vehicle.

Lastly, it is an object of the present invention to provide a new and improved antenna flag system. A slidable assembly is provided with a cylindrical section and a support section. The cylindrical section has an upper passageway and an axial slit. The support section has an upper strip extending from the upper end of the cylindrical section and a lower strip extending from the lower end of the cylindrical section. A flag has upper and lower edges. The flag is supported by the strips. A liftable assembly has a wing shaped component and a central passageway. A short projection extends upwardly press fit into the lower end of the cylindrical section of the slidable assembly. An intermediate cylindrical passageway is formed as a coupling between the lower and upper passageway.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a side elevational view of an antenna flag system constructed in accordance with the principles of the present invention illustrating in solid and in broken lines its operation on a vehicle.

FIG. 2 is a side elevational view of the antenna flag system illustrated in FIG. 1 but independent of a vehicle.

FIG. 3 is a front elevational view of the antenna flag system taken along line 3-3 of FIG. 2.

FIG. 4 is a plan view of the antenna flag system taken along line 4-4 of FIG. 3 and illustrating the flag holder in an open orientation.

FIG. 8 is a side elevational view similar to FIGS. 2 and 6 illustrating another alternate embodiment of the invention.

FIG. 9 is a rear elevational view taken along line 9-9 of FIG. 8.

The same reference numerals refer to the same parts throughout the various Figures.

DESCRIPTION OF THE PREFERRED EMBODIMENT

Figure 5:
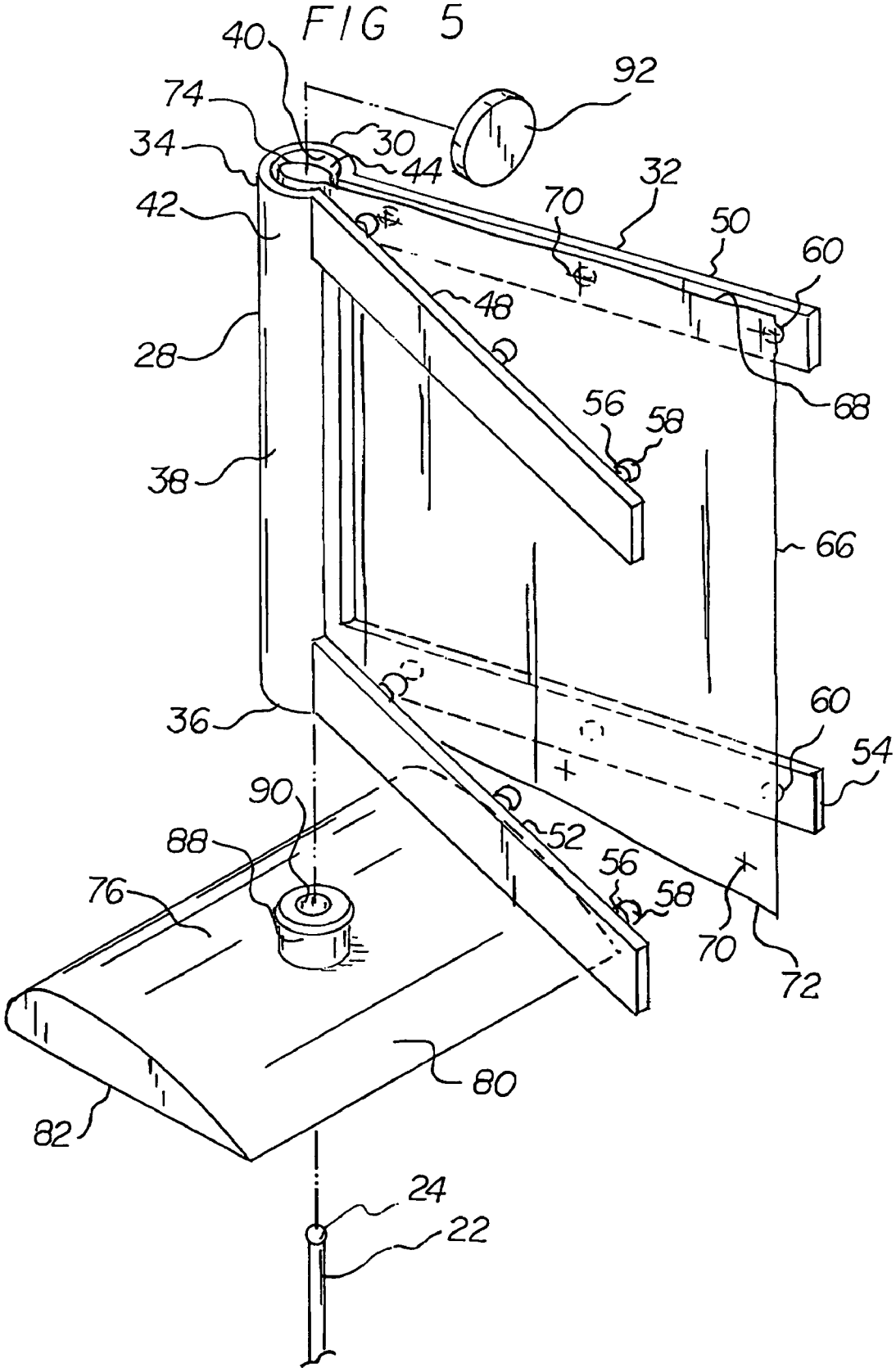
FIG. 5 is an exploded perspective illustration of the system illustrated in the prior Figures.

With reference now to the drawings, and in particular to FIG. 1 thereof, the preferred embodiment of the new and improved antenna flag system embodying the principles and concepts of the present invention and generally designated by the reference numeral 10 will be described.

The present invention, the antenna flag system 10 is comprised of a plurality of components. Such components in their broadest context include a slidable assembly, a support section, a flag and a liftable assembly. Such components are individually configured and correlated with respect to each other so as to attain the desired objective.

First provided is a vehicle 14. The vehicle is adapted to move horizontally. The vehicle has an essentially vertical antenna 16. The antenna has a free upper end 18. The antenna has a lower end 20. The antenna is attached to the vehicle with an intermediate extent 22. The intermediate extent is between about 12 and 36 inches in length. The antenna has a generally cylindrical configuration between the upper and lower ends. The upper end is formed with a sphere 24.

A slidable assembly 28 is provided. The slidable assembly is integrally formed with a cylindrical section 30 and a support section 32. The cylindrical section has an upper end 34. The cylindrical section has a lower end 36. The cylindrical section also has an intermediate extent 38. The intermediate extent is between about 4 and 8 inches. The intermediate extent is located between the upper and lower ends. The cylindrical section has an interior surface 40. The cylindrical section has an exterior surface 42. The cylindrical section also has an axial slit 44. The axial slit is adapted to be separated. In this manner a space for positioning the slidable assembly onto the antenna and for removing the slidable assembly from the antenna is formed. The axial slit is adapted to be closed. In this manner a closed upper cylindrical passageway for allowing movement of cylindrical section along the antenna is formed.

The support section has a planar upper male strip 48. The support section has a planar upper female strip 50. The planar upper female strip extends from the exterior surface adjacent to the upper end of the cylindrical section. The support section has a planar lower male strip 52. The support section also has a planar lower female strip 54. The planar lower female strip extends from the exterior surface adjacent to the lower end of the cylindrical section. The male strips have three laterally spaced projections 56. The laterally space projections have enlarged heads 58. The female strips have three laterally spaced apertures 60. The apertures are adapted to receive and frictionally retain the enlarged heads 62 when the axial slit is closed. In this manner the enlarged heads and apertures are separated when the axial slit is opened.

The upper strips and lower strips are axially separated to form a rectangular space between the upper and lower strips. A flag 66 is provided. The flag has an upper edge 68. The upper edge is formed with three laterally aligned upper slits 70. The upper slits receive the projections of the upper male strip. The flag has a lower edge 72. The lower edge is formed with three laterally aligned lower slits 70. The lower slits receive the projections of the lower male strip. The flag has an inner edge with a loop 74. The loop slidably receives the antenna.

Provided last is a liftable assembly 76. The liftable assembly has a laterally extending wing shaped component 78. The liftable assembly has an arcuate upper surface 80 and an essentially flat lower surface 82. The liftable assembly further has a centrally oriented lower cylindrical passageway 84 there through between the upper and lower surfaces. The liftable assembly has a short cylindrical projection 88. The short cylindrical projection extends upwardly from the upper surface press fit into the lower end of the cylindrical section of the slidable assembly. The liftable assembly has an intermediate cylindrical passageway 90. The intermediate cylindrical passageway is formed as a coupling between the lower cylindrical passageway between the upper and lower surfaces and the upper cylindrical passageway.

In this manner increased motion of the vehicle is adapted to exert an increased aerodynamic lifting force to the liftable and slidable assemblies whereby the flag is raised. With decreased motion of the vehicle, there is a decreased aerodynamic lifting force to the liftable and slidable assemblies for lowering the flag.

The liftable assembly includes a magnet 92. The magnet is removably positioned upon the sphere of the antenna. The magnet is of a size greater than that of the upper cylindrical passageway. In this manner movement of the slidable assembly and flag upwardly from the antenna is precluded.

Figure 6:
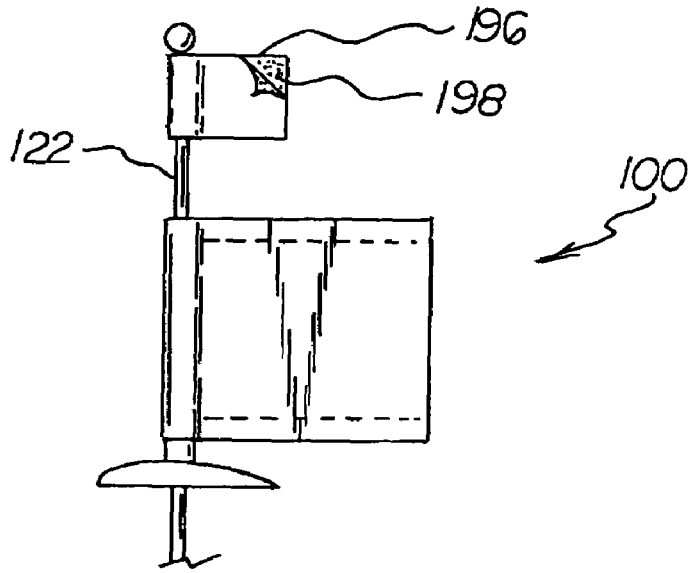
FIG. 6 is a side elevational view similar to FIG. 1 but illustrating an alternate embodiment of the invention.
Figure 7:
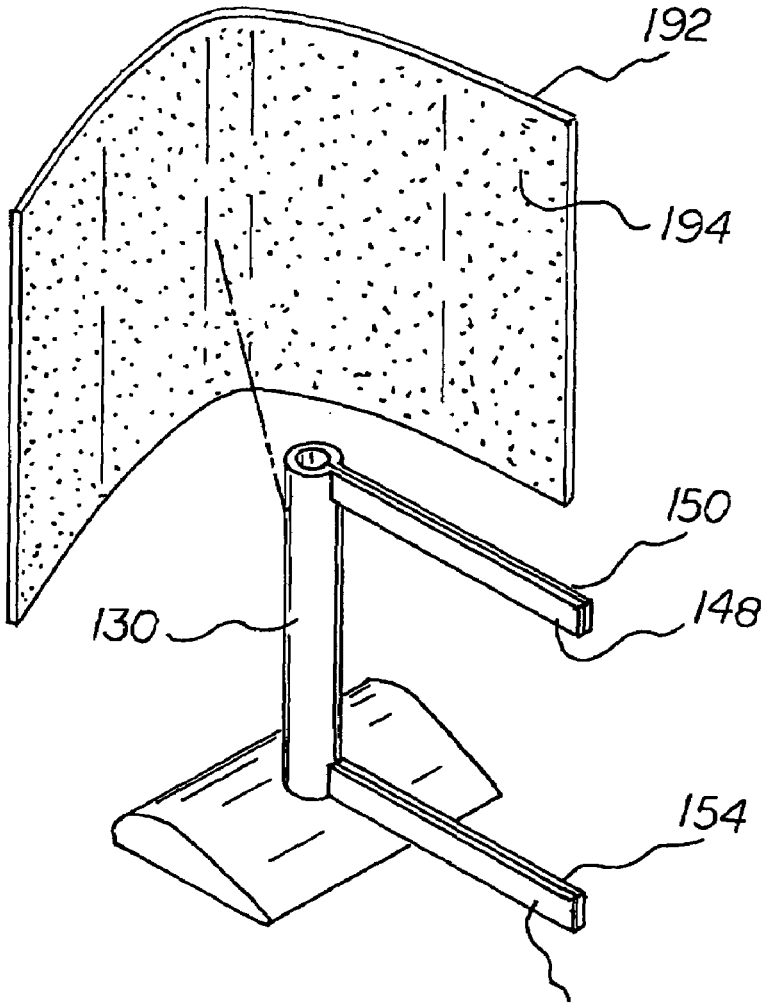
FIG. 7 is an exploded perspective illustration of the system shown in FIG. 6.

An alternate embodiment of the invention appears in FIGS. 6 and 7. Such alternate embodiment is a system 100 similar to the primary embodiment in most regards. In the alternate embodiment, the upper and lower strips include two separable upper strips 148, 150 and two separable lower strips 152, 154 with a flag 192 formed with an adhesive interior surface 194 positioned around the cylindrical section 130 and strips to hold the strips together during use. The alternate embodiment also includes a supplemental smaller flag 196 formed with an adhesive interior surface 198. Such smaller flag is positioned around an antenna 122 adjacent to an upper end thereof to preclude upward movement of the slidable and liftable assemblies with the flag from an antenna.

A final alternate embodiment is illustrated in FIGS. 8 and 9. In such embodiment, the system 200 includes a wing-shaped component 202 as in the prior embodiments. Unlike the prior embodiments, a decorative component 204 adapted to raise and lower with motion replaces the flag of the prior embodiments. Although the decorative component is represented in the drawings as a three-dimensional helmet, it should be understood that the helmet is representative only of one type of three-dimensional object, the decorative component could take the form of any of a variety of decorative objects, whether three-dimensional or two-dimensional. Coupling the wing-shaped component and the decorative component is a cylindrical projection 206. The cylindrical projection extends vertically upwardly from the center of the wing-shaped component and through the decorative component. The cylindrical projection includes a central cylindrical passageway 208 which extends through the decorative component and the wing-shaped component and is slidably received on the antenna of the vehicle. The wing-shaped component, decorative component and cylindrical component are adapted to raise and lower in a manner similar to the flag of the prior embodiments.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. An antenna flag system comprising a slidable assembly with a cylindrical section and a support section, wherein the cylindrical section comprising:

an upper end;

a lower end;

an upper passageway; and an axial slit;

the support section having:

an upper strip extending from the upper end of the cylindrical section; and a lower strip extending from the lower end of the cylindrical section;

a flag with upper and lower edges supported by the upper and lower strips of the support section;

a liftable assembly having:

a wing shaped component with a central passageway;

a short projection extending upwardly from the wing shaped component and having an intermediate cylindrical passageway, wherein the short projection presses fit into the lower end of the cylindrical section of the slidable assembly;

the intermediate cylindrical passageway formed as a coupling between the central passageway of the wind shaped component and the upper passageway of the cylindrical section; and an antenna supporting the cylindrical assembly and the liftable assembly.

2. The system as set forth in claim 1 wherein the strips include the support section having a planar upper male strip and a planar upper female strip extending from the exterior surface adjacent to the upper end of the cylindrical section and a planar lower male strip and a planar lower female strip extending from the exterior surface adjacent to the lower end of the cylindrical section, the male strips having a plurality of laterally spaced projections with enlarged heads, the female strips having a plurality of laterally spaced slits adapted to receive and frictionally retain the enlarged heads when the axial slit is closed and to separate the enlarged heads and apertures when the axial slit is opened.

3. The system as set forth in claim 1 and further including a vehicle with the antenna supporting the slidable assembly, the antenna being between about 12 and 36 inches in length and the cylindrical section of the slidable assembly being between about 4 and 8 inches in length whereby increased motion of the vehicle is adapted to exert an increased aerodynamic lifting force to the liftable and slidable assemblies to thereby raise the flag and decreased motion of the vehicle is adapted to exert a decreased aerodynamic lifting force to the liftable and slidable assemblies for lowering the flag.

4. The system as set forth in claim 1 wherein the upper and lower strips include two separable upper strips and two separable lower strips with a flag formed with an adhesive interior surface positioned around the cylindrical section and strips to hold the strips together during use.

5. The system as set forth in claim 1 and further including a supplemental smaller flag formed with an adhesive interior surface positioned around an antenna adjacent to an upper end thereof to preclude upward movement of the slidable and liftable assemblies with the flag from an antenna.

6. An antenna flag system for slidably positioning a flag on a vehicle antenna and then raising and lowering the flag in response to the speed of the vehicle comprising, in combination:

a vehicle adapted to move horizontally, the vehicle having an essentially vertical antenna, the antenna having a free upper end and a lower end attached to the vehicle with an intermediate extent between about 12 and 36 inches in length with a generally cylindrical configuration between the upper and lower ends, the upper end being formed with a sphere;

a slidable assembly integrally formed with a cylindrical section and a support section, the cylindrical section having an upper end and a lower end with an intermediate extent between about 4 and 8 inches located between the upper and lower ends, the cylindrical section having an interior surface and an exterior surface and an axial slit adapted to be separated to form a space for positioning the slidable assembly onto the antenna and for removing the slidable assembly from the antenna, the axial slit adapted to be closed to form a closed upper cylindrical passageway for allowing movement of cylindrical section along the antenna;

the support section having a planar upper male strip and a planar upper female strip extending from the exterior surface adjacent to the upper end of the cylindrical section and a planar lower male strip and a planar lower female strip extending from the exterior surface adjacent to the lower end of the cylindrical section, the male strips having three laterally spaced projections with enlarged heads, the female strips having three laterally spaced apertures adapted to receive and frictionally retain the enlarged heads when the axial slit is closed and to separate the enlarged heads and apertures when the axial slit is opened;

the upper strips and lower strips being axially separated to form a rectangular space there between and a flag with an upper edge formed with three laterally aligned upper slits receiving the projections of the upper male strip and a lower edge formed with three laterally aligned lower slits receiving the projections of the lower male strip, the flag having an inner edge with a loop slidably receiving the antenna;

a liftable assembly having a laterally extending wing shaped component with an arcuate upper surface and an essentially flat lower surface and a centrally oriented lower cylindrical passageway there through between the upper and lower surfaces, a short cylindrical projection extending upwardly from the upper surface press fit into the lower end of the cylindrical section of the slidable assembly with an intermediate cylindrical passageway formed as a coupling between the lower cylindrical passageway between the upper and lower surfaces and the upper cylindrical passageway whereby increased motion of the vehicle is adapted to exert an increased aerodynamic lifting force to the liftable and slidable assemblies to thereby raise the flag and decreased motion of the vehicle is adapted to exert a decreased aerodynamic lifting force to the liftable and slidable assemblies for lowering the flag, the liftable assembly including a magnet removably positioned upon the sphere of the antenna of a size greater than that of the upper cylindrical passageway to preclude movement of the slidable assembly and flag upwardly from the antenna.

* * * * *